US005082277A

United States Patent [19]

Gingold

[11] Patent Number: 5,082,277

[45] Date of Patent: Jan. 21, 1992

[54] GOLF PUTTER

[76] Inventor: Allen Gingold, P.O. Box 7451, Rego Park, N.Y. 11374

[21] Appl. No.: 703,284

[22] Filed: May 20, 1991

[51] Int. Cl.[5] ..... A63B 53/00

[52] U.S. Cl. ..... 273/164; 273/167 F; 273/169

[58] Field of Search ..... 273/163 R, 164, 167 R, 273/167 F, 167 G, 167 J, 167 K, 169, 171, DIG. 1

[56] References Cited

U.S. PATENT DOCUMENTS

| | | | |
|---|---|---|---|
| D. 234,962 | 4/1975 | Swash | D21/02 |
| D. 245,441 | 8/1977 | Middlestadt | D21/02 |
| 2,954,231 | 9/1960 | MacIntyre | 273/164 |
| 2,957,696 | 10/1960 | Warpotas | 273/164 |
| 3,143,349 | 8/1964 | MacIntyre | 273/171 |
| 3,220,733 | 11/1965 | Saleeby | 273/164 X |
| 3,233,905 | 2/1966 | Flom | 273/167 G X |
| 3,319,962 | 5/1967 | Summers | 273/164 |
| 3,448,981 | 6/1969 | Anweiler | 273/164 X |
| 3,888,484 | 6/1975 | Zitko | 273/164 X |
| 3,989,257 | 11/1976 | Barr | 273/164 X |
| 4,141,556 | 2/1979 | Paulin | 273/164 |
| 4,512,583 | 4/1985 | De Vilmorin | 273/168 |
| 4,712,798 | 12/1987 | Preato | 273/164 |
| 4,747,599 | 5/1988 | Antonious | 273/164 X |

*Primary Examiner*—William H. Grieb
*Attorney, Agent, or Firm*—Kelly & Hulme

[57] ABSTRACT

According to the present invention there is provided a novel golf club for use in putting. The novel putter, in a preferred embodiment is comprised of a light weight, plastic club head having a front rectangular portion and a rear triangular portion for weighting the head such that the force produced to swinging the club is in the "sweet spot" thereof and a shaft joined to said head along the center line thereof. The above invention results in a club that is easy to use, that guides the user with the desired horizontal (as opposed to an arc or pendulum) swing, that is light weight, which focuses the energy of the putter at the club "sweet spot" which reduces the twisting tendency of the club and increases the size of the "sweet spot".

10 Claims, 2 Drawing Sheets

GOLF PUTTER

BACKGROUND OF THE INVENTION

The present invention is drawn to a club for use in playing golf and more particularly to a putter for use when striking a golf ball after it has arrived on a golf course green.

As is well known in the sport of golf, the proper putting swing is a horizontal swing which maintains the putter club head a constant distance above the surface upon which the golf ball to be struck is located when the putter is swung. When properly executed the swing results in a smooth straight horizontal stroke as a result of which the golf ball, when struck, moves along the desired path.

The putter swing, which as indicated above is a horizontal swing, is in contrast to the arc or pendulum swing used with the typical fairway clubs (i.e.: woods; irons; wedges and the like). The difference in the nature of the two swings necessitates a difference as to how and where the different clubs are weighted. The fairway clubs, which are designed to move the golf ball longer distances, are best enhanced through the use of perimeter weighting around the striking face of the club head. Conversely, the golf putter, which is designed to move the ball short, accurate distances, is best enhanced by a system that directs or focuses the weight and, therefore the force (when the club head is moving), at the center of the club head where the ball is to be struck. This center spot is typically called the "sweet spot".

In addition, in order to provide a comfortable stance for and to keep the club shaft out of the club user's line of sight, the club shaft is typically attached to the club head at an angle. Unfortunately this arrangement causes the club head to twist when striking the ball which would clearly have a detrimental imput on the golf shots being undertaken.

It is, therefore, an object of the present invention to provide a golf club for use on a golf course green as a putter for striking a golf ball toward a golf hole.

It is another object of the present invention to provide a golf putter which will guide the user in the proper horizontal swing most successfully employed when putting:

It is yet another object of the present invention to provide a golf putter which allows for a more stable golf swing.

It is still another object of the present invention to provide a golf putter that is light weight but which focuses sufficient force when striking a golf ball to allow for more accurate putting on a golf course green.

It is yet another object of the present invention to provide a putter having an enlarged "sweet spot" (the area on the putter striking surface which may strike the golf ball and still produce a relative straight putt on a flat horizontal surface).

It is still another object of the present invention to dampen the twisting tendency of the typical golf putters found in the prior art.

These and other objects of the present invention will be apparent to those skilled in the art from the following specification and claims taken together with the accompanying drawings.

SUMMARY OF THE INVENTION

In accordance with the present invention a putter for use on a golf course green for striking a ball into a golf hole is provided which is comprised a polycarbonate golf putter head member, a shaft joined thereto, a gripping areas provided on said shaft and sighting means provided on said head member for lining up a golf shot.

The putter head member is comprised of a front rectangular portion and an integrally formed rear triangular portion, said front rectangular portion having a generally vertical ball striking surface and two side surface, the rear triangular portion having side surfaces tapering toward the lateral center line of said head member, each of said portions having top faces constituting one continuous top surface disposed at about a right angle to said striking surface and further having bottom faces constituting one continuous bottom surface disposed at about a right angle to said striking surface and parallel to said top surface.

The putter of the present invention is comprised of weighting means such that the overall club weight is relatively low while still focusing sufficient force at a golf ball when the putter strikes said ball to accurately move the ball into the golf hole.

Finally, in an alternate embodiment of the present invention second weighted means may be provide which means are sized and located to prevent twisting of the club and enlargement of the club "sweet spot" when the club is used to strike a golf ball.

DETAILED DESCRIPTION OF THE INVENTION

Figure 1:
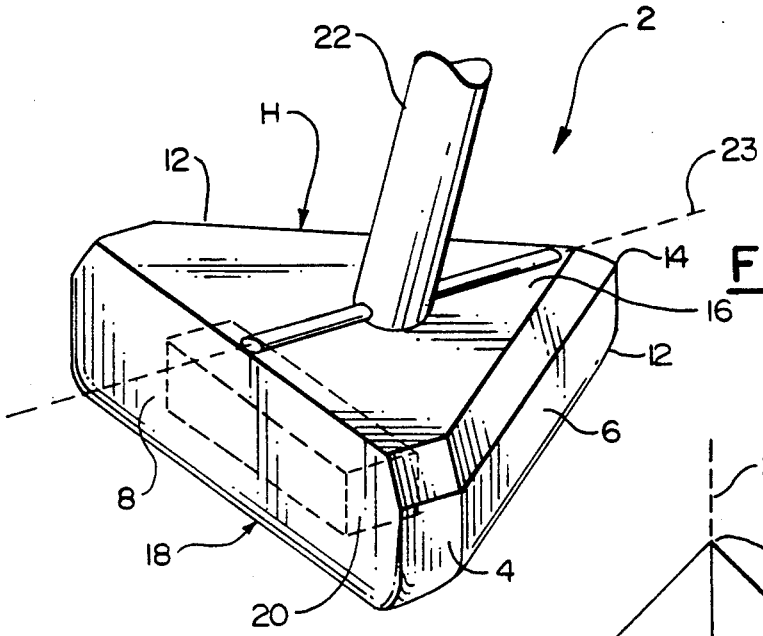
FIG. 1 is a perspective view of the golf putter of the present invention.
Figure 2:
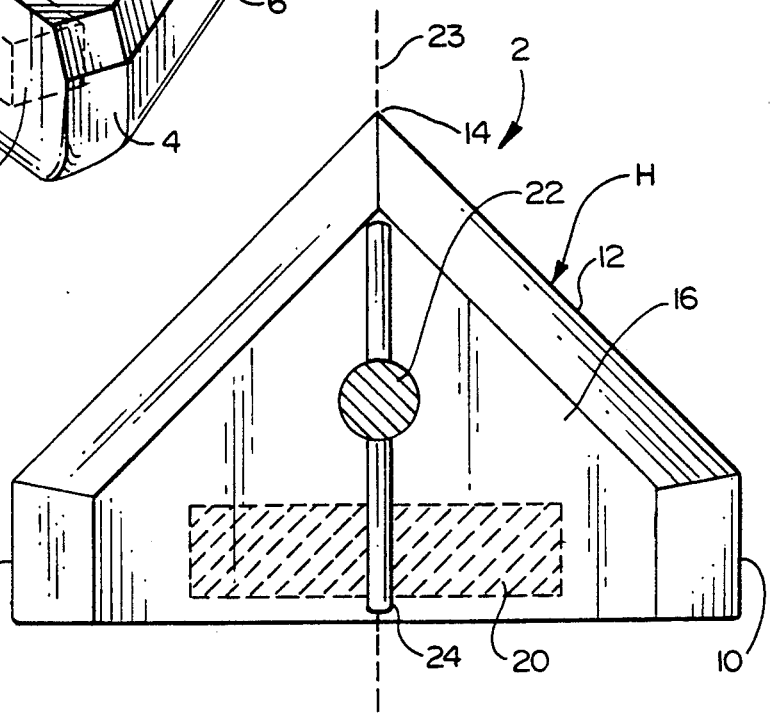
FIG. 2 is a top view of the golf putter of the present invention.
Figure 3:
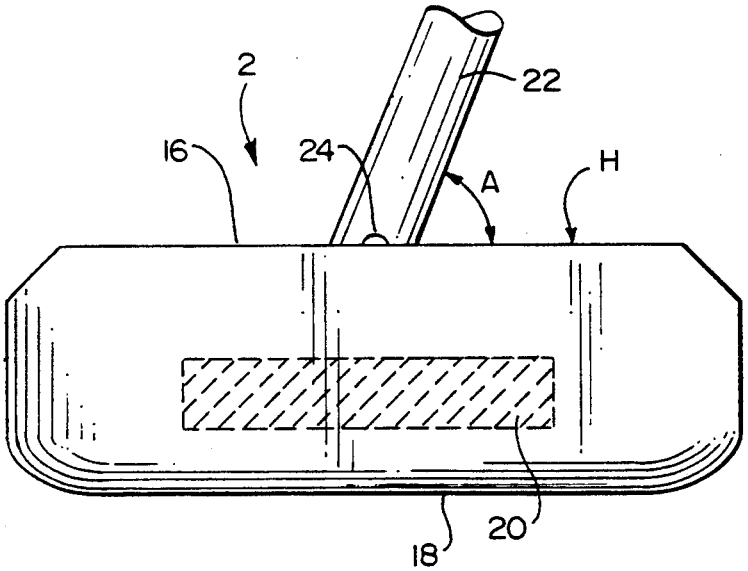
FIG. 3 is a front view taken along line 3—3 of the golf putter of FIG. 1.
Figure 4:
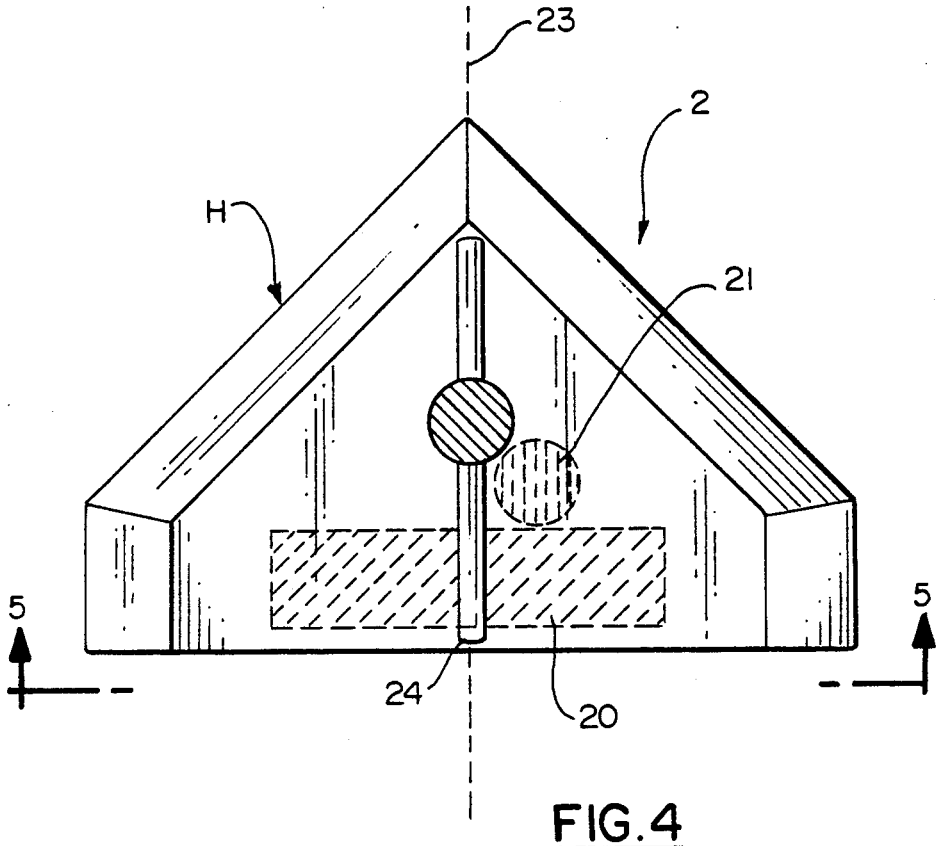
FIG. 4 is atop view of the golf putter of the present inventor showing an additional weighty feature.
Figure 5:
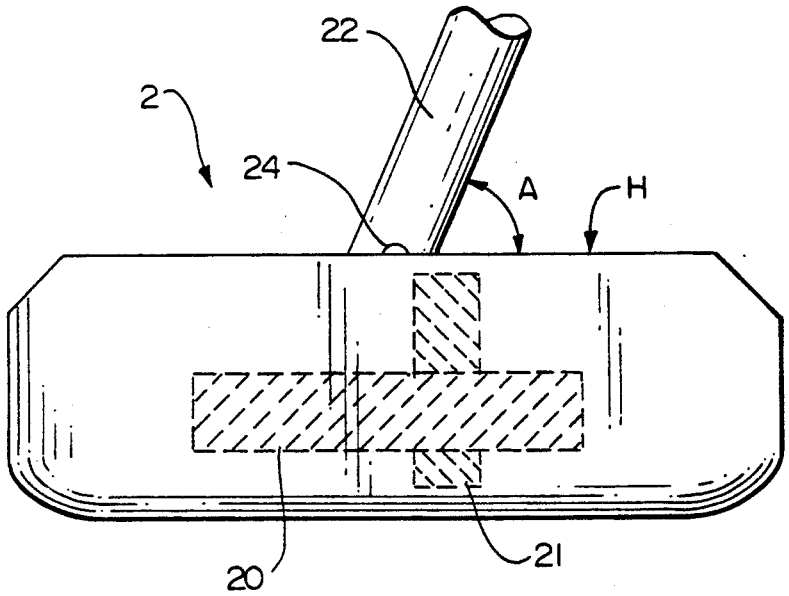
FIG. 5 is a front view taken along line 5—5 of FIG. 4.

The head member H of the putter 2 in accordance with the present invention is depicted in FIGS. 1 to 3. The head H is comprised of a front rectangular portion 4 integrally formed with a rear triangular portion 6. The front portion 4 is defined by front surface 8 and two side surfaces 10 (which are preferably but not necessarily perpendicular to said front surface 8); and a top and bottom face. The triangular portion 6 located to the rear of the rectangular portion 4 and integrally formed therewith is defined by two side surfaces 12 which taper to the lateral center line 14 of the putter 2; and a top and bottom face. The top face of each of the front 4 and rear 6 portions of the head H form a continuous top surface 16 of head H the bottom face of each of said front 4 and rear 6 portions form one continuous bottom surface 18 of head H which bottom surface 18 is disposed parallel to said top surface 16 and each of said bottom and top surfaces being generally perpendicular to said front surface 8 of said front rectangular portion 4.

The front surface 8 of club head H functions as the striking surface of said club such that when putter 2 is swung towards a golf ball it is this surface that actually contacts said ball. Although, said front striking surface 8 is referred to as being substantially vertical, it may, in an alternate embodiment of the present invention be inclined or angled either positively or negatively relative to the vertical plane through the striking surface which has the effect of altering the loft (i.e.: angle) of the striking surface.

As can be seen from the drawings, the width of front striking surface 8 is quite broad relative to the diameter of the typical golf ball said width being most preferably two to three times wider then said ball. In addition, the depth of the club (i.e.: the distance from the front surface 8 to the lateral center point 14 of the triangular portion 6) is also relatively large, being most preferably approximately equal to the width of the front striking surface 8. The broad nature of the length and width of the present golf putter 2 guides the putter when used such that the desired horizontal swing sought when putting may more readily be achieved.

As can be seen in FIGS. 1 and 3, the edge of said head H around the continuous bottom surface 18 is preferably rounded or beveled. This prevents the putter 2 from dragging or catching on the ground as the putter is swung which dragging or catching may have a detrimental effect on the putt. In addition, the edges of the top surface 16 may also be angled or rounded, mainly for decorative purpose, but also to further reduce the overall weight without losing the attributes exhibited by the putter 2 due to its broad size.

As shown in FIG. 1, 2 and 3, a weighted member 20 is imbedded in the club head H. This weighted member 20, the weight of which may be selected during the manufacturer of the club based on the desires of the golfer, is positioned directly behind the striking surface 8 of the club head H extends substantially the entire width of said putter striking surface 8 and is most advantageously positioned in the center portion of the club head H. The weight providing member 20 is most preferably formed from a metal such as lead, steel or brass but may be any material of a density higher then that of the polycarborate used to form the club head member H such that the advantage of the focused weighting system TM of the present invention, as described below, is obtained.

The golf putter 2 is provided with a shaft 22 which is constructed from any suitable material including but not limited to wood, graphite, graphite composites, aluminum, steel or other like material. The shaft 22 has a first end which is rigidly fixed to the top continuous surface 16 of said club head H, said first end being most advantageously fixed along the "heel to toe" center line 23 of said club head H within the top face of said triangular portion 6. At a second end of the shaft 22 is provided a handle grip (not shown) which enhances the ability of the club user to grip and firmly hold the putter of the present invention. The shaft 22 is joined to the top surface 16 of club head H at an angle "A" such that when the putter 2 is gripped at said shaft end the club head H is maintained in the desired parallel relationship with the ground. As will be clear to those skilled in the art, the putter 2 depicted in the drawings is for use by the typical right handed golfer. This is evident from the fact that angle "A" causes the shaft 22 to be angled to the right side of the club as you face the club striking surface. it will be equally clear to those skilled in the art that in order to create a left handed club the shaft 22 may be mounted to head H such that it angles to the left side of the head H. The shaft, in addition to being angled to one side, may also be tilted towards the back of the club head H so that said golfer hands, used to grip the shaft to the first end thereof will not block the golfer's view of the ball to be struck.

As an additional feature of the present invention it has been found desirable to provide sighting means on the club head which means are comprised of a sighting member 24 fixed to the top surface 16 of the putter head H which sighting member 24 extends along a portion of the center line 23 on the top surface of the putter head H from the shaft 22 to the striking surface 8. In other words, the sighting member is located perpendicular to the striking surface 8. The sighting member 24, as can be seen in the drawings, is an elongated member having a semi-circular cross-section and is most preferably has a color which is different from the color of the club head H itself. The sighting member 24, due to its contrasting color and location, provides a visual guide for the putter user in lining up the putter and the golf ball to be struck with the golf hole.

The putter head H of the present invention may be made of any suitable material which is light weight yet has sufficient resilience so as not to shatter and/or to "deaden" the collision between the golf ball and putter. The head H is most advantageously formed from a polycarborate plastic material such as Lexan TM or the like.

The putter head H of the present invention may be constructed of a single unitary piece of plastic material either molded or machined to the desired shape, with a cavity hollowed out for receiver of the weighting member 20. However, the head H is more preferably constructed from laminated layers or tiers of the polycarborate material with an internal space provided to receive said weighting member in the appropriate location.

In an alternate embodiment of the present invention the club head in addition to being comprised of the above described elements is further comprised of a second weighted member 21 which second weighted member 21 is imbedded within club head H during the manufacture of the club behind (and preferrably directly behind) said first weighted member 20 and to one side and adjacent to said center line 23. The side of said center line 23 to which said second weighted member 21 is disposed is based on whether the club is for use by right handed golfer or a left handed golfer and is located on the side to which the club shaft 22 is angled; i.e. to the right of said center line 23 as you face the striking surface 8 for a right handed club and to the left of said center line 23 for a left handed club. The effect of this second weighted member 21 is to reduce the tendency of the putter 2 of the present invention to twist when a golf ball is struck (especially when the ball is struck somewhere other than in the center of said striking surface 8) which tendency is an inherent feature of the angled connection between the head H and shaft 22. As a further result of this reduced twisting tendency, the golf putter "sweet spot" (i.e. the area along the striking surface 8 where golf ball may be hit and still produce a straight movement of the ball) is somewhat enlarged.

Thus it can be seen from the drawings and the above description, a golf putter having superior stability and "feel" with a focused weight system TM is produced. The relative large (both in width and depth) club head H in combination with the angle which the shaft 22 attached to said head H help guide the club head H so that the smooth horizontal (rather then an arc or pendulum) swing desired when putting is achieved. In addition, the broad generally flat bottom surface 18 allows the user to rest the club in approximately the same orientation as when the club strikes the ball while the golf ball is being addressed.

The shape of the putter head H and the light weight polycarborate construction material along with the denser weighting means allow for a club that is lightweight overall and easy to swing and yet imparts the proper level of force to the golf ball without requiring an increase in club head speed over what would be employed with a typical golf putter. Furthermore, the location of said weighting means at the center front of the club head second weighted member provided in the club head results in a sensitive, yet firm "feel" for the user of the club, a club with a reduced twisting tendency when used and a club being an substantially increased "sweet spot" which will result in a more accurate putt. Finally mounting the shaft along the center line of the club head H and the location of the sighting member along at least a portion of said center line, assists the user in lining up his or her shot.

While the preferred form of the present invention has been described in considerable detail, it will be understood by those skilled in the art that the present invention is not limited to the construction shown nor the uses referred to herein and it is the inventors intention to cover all adaptions, modifications and changes within the practice of those skilled in the art to which the invention relates without departing form the spirit and scope of the appended claims.

What is claimed is:

1. A putter for use on a golf course green for striking a golf ball and directing said ball into a golf course hole, comprising:

a polycarborate golf putter head member having a front rectangular portion and an integrally formed rear triangular portion, said front rectangular portion having a generally vertical striking surface, and two side surfaces, said front and rear portions having top faces together constituting one continuous top surface disposed at about a right angle to said striking surface and said portions further having bottom faces together constituting one continuous bottom surface disposed parallel to said continuous top surface, said rear triangular portion further having side faces tapering towards a lateral center point of said putter head member, said head having a "heel to toe" center line which extends across said top surface from the center of and perpendicular to said striking surface and extending rearwardly to a lateral center point;

means for weighting said head such that the overall head weight is generally light while focusing sufficient force at the point of impact between the club and golf ball to be struck;

sighting means for permitting a golfer to properly align said head member with said golf ball;

a shaft having a first end and second end said first end being fixed to the top surface of said head member for allowing the golf putter to be swung; and gripping means provided at such shaft second end for allowing a user of said putter to grasp said shaft.

2. The putter of claim 1 wherein said weighting means is comprised of an elongated weighted member embodied within said head member directly behind said striking surface with said weight providing member extending along substantially the entire width of said club head.

3. The putter of claim 2 wherein said weighted member is further located within said club head member and is equidistant from said top surface and said bottom surface.

4. The putter of claim 1 further comprising means for sighting the putter.

5. The putter of claim 4 wherein said sighting means is comprised of an elongated member having a semi-circular cross section fixed along at least a protion of the "head to toe" center line of said club head.

6. The putter of claim 1 wherein said shaft is fixed to said club head at a point along said "heel to toe" center line at an angle sufficient to allow a user to comfortably hold said club while maintaining said club head in a horizontal position over the ground.

7. The matter of claim 1 wherein the width of said striking surfaces is two to three times greater then the diameter of a golf ball.

8. The putter of claim 7 wherein said club head has a depth substantially equal to said width.

9. The putter of claim 1 wherein the edges of said bottom surface are rounded.

10. The putter of claim 1 further comprising a second weighted member imbedded within said club head behind said first weighted member and adjacent and to one side of the center line of said head, which second weighted member reduces the tendency of said putter to twist when used to strike a golf ball and increased the putter "sweet spot".

* * * * *